US005199588A

United States Patent [19]

Hayashi

[11] Patent Number: 5,199,588

[45] Date of Patent: Apr. 6, 1993

[54] BIAXIALLY BLOW-MOLDED BOTTLE-SHAPED CONTAINER HAVING PRESSURE RESPONSIVE WALLS

[75] Inventor: Yoshiaki Hayashi, Matsudo, Japan

[73] Assignee: Yoshino Kogyosho Co., Ltd., Tokyo, Japan

[21] Appl. No.: 465,227

[22] PCT Filed: Sep. 29, 1989

[86] PCT No.: PCT/JP89/00988

§ 371 Date: Feb. 14, 1990

§ 102(e) Date: Feb. 14, 1990

[87] PCT Pub. No.: WO91/04912

PCT Pub. Date: Apr. 18, 1991

[30] Foreign Application Priority Data

Apr. 1, 1988 [JP] Japan ..... 63-44275[U]

[51] Int. Cl.[5] ..... B65D 1/02

[52] U.S. Cl. ..... 215/1 C; 220/666; 220/669

[58] Field of Search ..... 215/1 C; 220/606, 609, 220/666, 669, 675; D9/401, 411

[56] References Cited

U.S. PATENT DOCUMENTS

| | | | |
|---|---|---|---|
| D. 178,259 | 7/1956 | North | D9/401 |
| D. 203,884 | 2/1966 | Wood | D9/411 |
| D. 275,267 | 8/1984 | Gautier | D9/411 X |
| D. 294,679 | 3/1988 | Griesing et al. | D9/411 |
| D. 308,482 | 6/1990 | Wild | D9/401 |
| 4,863,046 | 9/1989 | Collette et al. | 215/1 C |
| 4,890,752 | 1/1990 | Ota et al. | 220/606 X |

FOREIGN PATENT DOCUMENTS

| | | | |
|---|---|---|---|
| 324305 | 7/1989 | European Pat. Off. | 215/1 C |
| 2635494 | 3/1978 | Fed. Rep. of Germany | 215/1 C |
| 90987 | 3/1962 | France | 215/1 C |
| 1351140 | 12/1963 | France | 215/1 C |
| 61-117109 | 7/1986 | Japan . | |
| 62-82922 | 5/1987 | Japan . | |

*Primary Examiner*—Sue A. Weaver
*Attorney, Agent, or Firm*—Oliff & Berridge

[57] ABSTRACT

A biaxially blow-molded bottle-shaped container (1) of synthetic resin includes a generally square cross-sectional body portion (2). A panel wall (3) for absorbing a reduced pressure generated in the bottle-shaped container is provided on a flat wall portion at each side of the body portion. Depressed cross grooves (5) are provided spaced apart in parallel in a ridge line portion between the adjacent panel walls (3, 3). The body portion may be cut-off at corners thereof to provide vertically elongated flat surfaces (4), and depressed cross grooves (5) may be provided spaced apart in parallel in each flat surface (4).

2 Claims, 3 Drawing Sheets

PRIOR ART

BIAXIALLY BLOW-MOLDED BOTTLE-SHAPED CONTAINER HAVING PRESSURE RESPONSIVE WALLS

BACKGROUND OF THE INVENTION

1. Field of the Invention

The present invention relates to a biaxially blow-molded bottle-shaped container made of synthetic resin, more particularly to a construction of a body portion of a biaxially blow-molded bottle-shaped container made of polyethylene terephthalate resin.

2. Prior Art

There has hitherto been widely used a bottle-shaped container which is produced by biaxially blow-molding a preformed parison of synthetic resin such as polyethylene terephthalate resin. Such a bottle-shaped container has an excellent resistance to contents which is provided by sufficiently orienting the preformed parison. The bottle-shaped container is formed with a thin wall and is light. The container has an excellent shock resistance and can be inexpensively produced by mass production.

However, there is a problem that when the bottle-shaped container is filled with a hot liquid content and subsequently cooled, the wall of the body portion of the bottle-shaped container is deformed owing to a reduced pressure in the container.

Accordingly, there has been known to provide panel walls in the body portion to absorb the reduced pressure by an elastic deformation of the panel walls. It is required that each panel wall is relatively large flat wall construction due to the following reasons. (1) By the reduced pressure, the panel wall is more deformable than the rest of the body portion. (2) The depression deformation occurring on the panel wall is an elastic deformation. (3) Only a little depression-deformation decreases the volume of the container a large amount.

A large biaxially blow-molded bottle-shaped container having a cylindrical body portion of a circular section can be provided with reduced-pressure absorbing panels only by forming vertically extended flat portions on the peripheral surface portion of the body portion. Therefore, the shape of the panel walls on the body portion of the container is vertically elongated and as a result, the panel walls of the container cannot be greatly deformed. Therefore, the volume of the bottle-shaped container does not greatly vary by the depression-deformation of the panel walls on the body portion of the bottle-shaped container.

A large biaxially blow-molded bottle-shaped container having a cylindrical body of a square section can be provided with reduced-pressure absorbing panels by forming a flat portion on each side of the square cylindrical body portion. Each flat portion can be easily and sufficiently deformed and has a large flat area so that the volume of the container can be greatly varied by the deformation of the flat portions. Thus, each flat portion effectively acts as a panel wall for absorbing the reduced pressure.

FIG. 3 illustrates a conventional bottle-shaped container 1' having a square cylindrical body portion 2'. Each side surface of the body portion 2' continues to adjacent both side surfaces through ridge line portions, respectively. Each side surface of the body portion is provided with a reduced-pressure absorbing panel wall 3' for absorbing the deformation of the wall of the bottle-shaped container caused by the reduction of the pressure in the container.

When the pressure in the bottle-shaped container 1' is reduced, the panel wall 3' is deformed and inwardly bent to cause an internal stress extended to the ridge line portions. The ridge portions are pillar portions for maintaining the shape of the bottle-shaped container and must have a high mechanical strength. If the ridge portions are deformed by the internal stress, the mode of bending of the panel wall 3' is not constant and the body portion of the square cylindrical shape is deformed. In particular, large bottle-shaped containers are greatly deformed by the reduced pressure, because the large bottle-shaped containers have a thin wall owing to a deep orientation and a large height thereof. Thus, the large bottle-shaped containers are required to have ridge line portions having a high mechanical strength.

In order to eliminate the aforementioned problems, there has been designed to provide elongated grooves 5' in the ridge line portions. Such an elongated groove 5' acts as a reinforcing rib to increase the mechanical strength in the ridge line portion to thereby prevent the ridge line portion from undue strain deforming owing to the deformation of the panel wall 3'.

Generally, biaxially blow-molded bottle-shaped containers produced in a factory are packed in cases made of a corrugated cardboard and transported to other factories for filling liquid into the bottle-shaped containers. The bottle-shaped container is light, but is bulky. Consequently, in order to efficiently transport the bottle-shaped containers, it is desirable that a number of bottle-shaped containers are closely packed in each cardboard case.

However, when uncapped bottle-shaped containers as shown in FIG. 3 are closely packed within the cardboard case and are subjected to an external pressing force over a limit of the resistance force of the ridge line portions having a mechanical strength sustained by the elongated grooves 5', the ridge line portions are inwardly bent to result in a bending deformation. This bending-deformation is semi-permanently since the elongated grooves 5' act as reinforcing ribs in the condition of bending deformation to prevent the ridge line portions from elastically returning back to the original form.

SUMMARY OF THE INVENTION

It is an object of the present invention to eliminate the aforementioned problems and disadvantages in the prior art and to provide a bottle-shaped container adapted for preventing the ridge line portions from inwardly bending and semi-permanently deforming by the external pressing force applied to the body portion of the bottle-shaped container, and also maintaining necessary mechanical strength.

According to the present invention, there is provided a biaxially blow-molded bottle-shaped container (1) of synthetic resin including a generally square cross-sectional body portion (2), wherein a panel wall (3) for absorbing a reduced pressure generated in the bottle-shaped container is provided on a flat wall portion at each side of the body portion, and depressed cross grooves (5) are provided spaced apart in parallel by a constant distance in a ridge line portion between the adjacent panel walls (3, 3).

The body portion may be cut-off at corners thereof to provide vertically elongated flat surfaces (4), and depressed cross grooves (5) may be provided spaced apart in parallel by a constant distance in each flat surface (4).

When a pressure in the bottle-shaped container is reduced by cooling after a hot liquid is filled in the container, the reduction of the pressure is sufficiently absorbed by elastic depression-deformation of the panel walls (3) of the body portion. When the panel walls (3) are elastically depression-deformed to cause an internal stress, this internal stress acts to the ridge line portions between adjacent panel walls (3, 3'). The internal stress consists of a component of force withdrawing inwardly the ridge line portions and a component of force pressing each ridge line portion from the opposite sides thereof.

The cross grooves (5, 5) depressed in the ridge line portion will act to inwardly bend the ridge line portion against the force withdrawing inwardly the ridge line portion. The ridge line portion is subjected to the withdrawing force as well as the pressing forces from the opposite sides thereof as mentioned above. The ridge line portion tends to protrude radially and outwardly owing to the forces pressing the ridge line portion from the opposite sides thereof. Thus, the ridge line portions act as reinforcing ribs against the withdrawing force and provide a high mechanical strength.

Accordingly, when uncapped bottle-shaped containers (1) closely packed within the cardboard case are subjected to a force pressing sidewardly the body portion (2) and the pressing force increases higher than a predetermined value, the ridge line portions are elastically deformed inwardly all over the same owing to the cross grooves which are transversely depressed in the ridge line portion. Thus, the external pressing force is absorbed by the elastic bending-deformation of the ridge line portion all over the same. In this case, since the deformation of the ridge line portions is an elastic deformation, the deformed ridge line portions are elastically returned to the original form when the external pressing force is released. Accordingly the ridge line portions are not semi-permanently deformed.

A corner of the body portion (2) may be cut-off to provide flat ridge line portions. Thus, each ridge line portion has corners (7) formed at its opposite sides and each cross groove (5) also has corners (7*a*) formed at its opposite sides. These corners (7 and 7*a*) arranged at the opposite sides of the each ridge line portion can act as reinforcing ribs against an elastic bent deformation of the central portion of the ridge line portion. Thus, the opposite side portions of the ridge line portion have a stress to extrude radially and outwardly from the ridge line portion by a force pressing the ridge portion from the opposite sides thereof due to the deformation of the panel wall. As a result, the function mechanically supporting the ridge line portion in the deformation of the panel wall is increased. Since the central portion of the ridge line portion is flat, the ridge line portion can be elastically deformed by the external pressing force. Consequently, when the body portion of the bottle-shaped container which is not filled with liquid is subjected to a large external pressing force, the whole ridge line portion can be more greatly elastically deformed without semi-permanent bending-deformation and as a result the faculty of absorbing the external force is increased by the elastic deformation of the whole ridge line portions and also a sufficient mechanical strength to maintain the shape of the bottle-shaped container is sustained.

DESCRIPTION OF THE PREFERRED EMBODIMENT

The preferred embodiment of the present invention will hereinafter be described with reference to the drawings.

A bottle-shaped container 1 is a large bottle having a thin wall which is produced by biaxially blow-molding a preformed parison made of a synthetic resin. In this embodiment, the bottle-shaped container 1 is made of a polyethylene terephthalate resin.

The bottle-shaped container 1 has a generally square cross-sectional body portion 2. This body portion 2 is provided at each side of the container in about the two-third part of the lower portion thereof with panel walls 3 for absorbing deformation caused by reduced pressure in the container.

Each panel wall 3 may be provided at its central portion with one or more depressed portions 3*a* which absorb the reduced pressure in the container. The depressed portion 3*a* effectively permits deformation of the whole panel wall 3 owing to the reduced pressure without undue straining. In the illustrated embodiment, two depressed portions 3*a*, 3*a* are formed at positions vertically spaced apart in each panel wall on each side of the body portion, but an elongated depressed portion may be provided in each panel wall 3.

Figure 1:
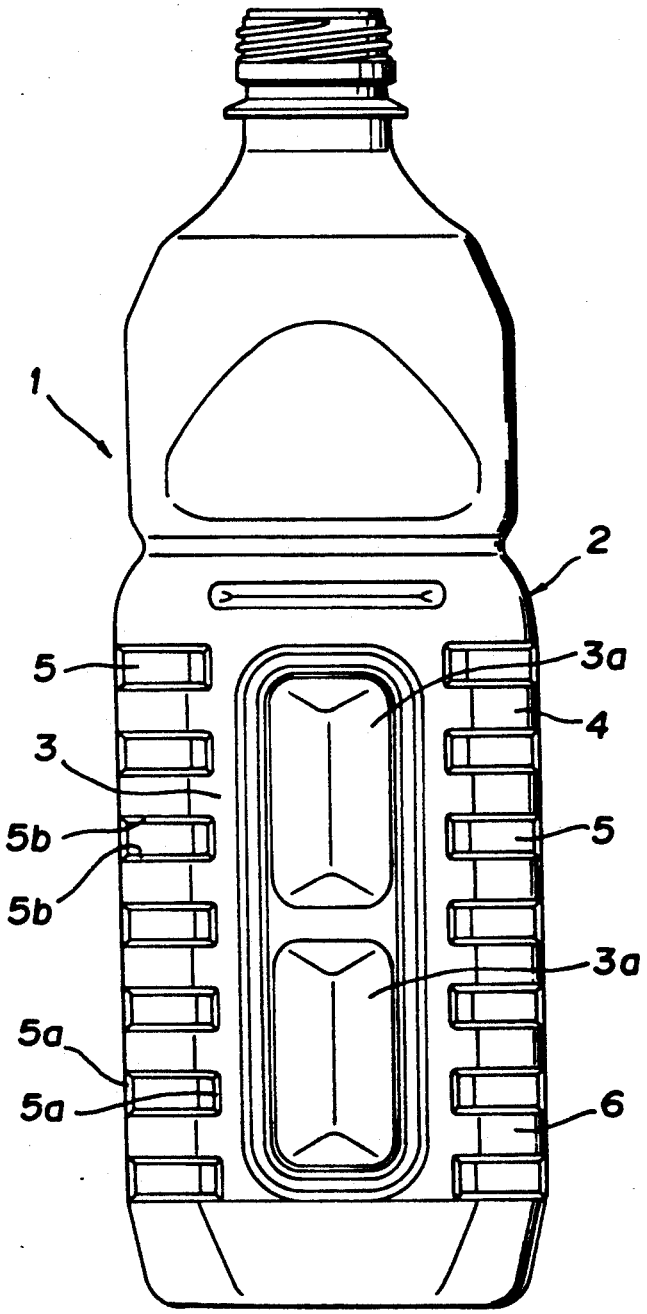
FIG. 1 is a front view of an embodiment of a biaxially blow-molded bottle-shaped container according to the present invention.
Figure 2:
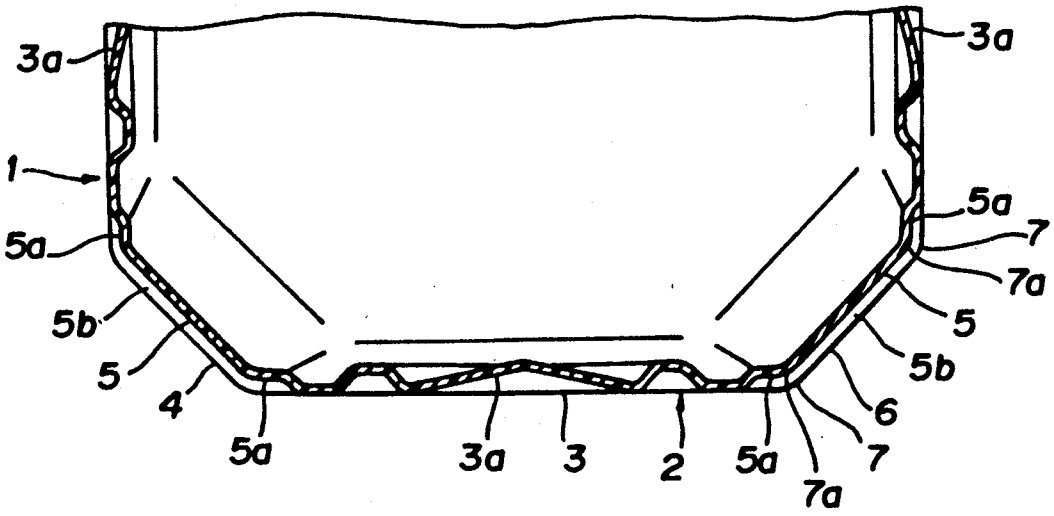
FIG. 2 is an enlarged sectional view of the essential portion of the bottle-shaped container shown in FIG. 1.
Figure 3:
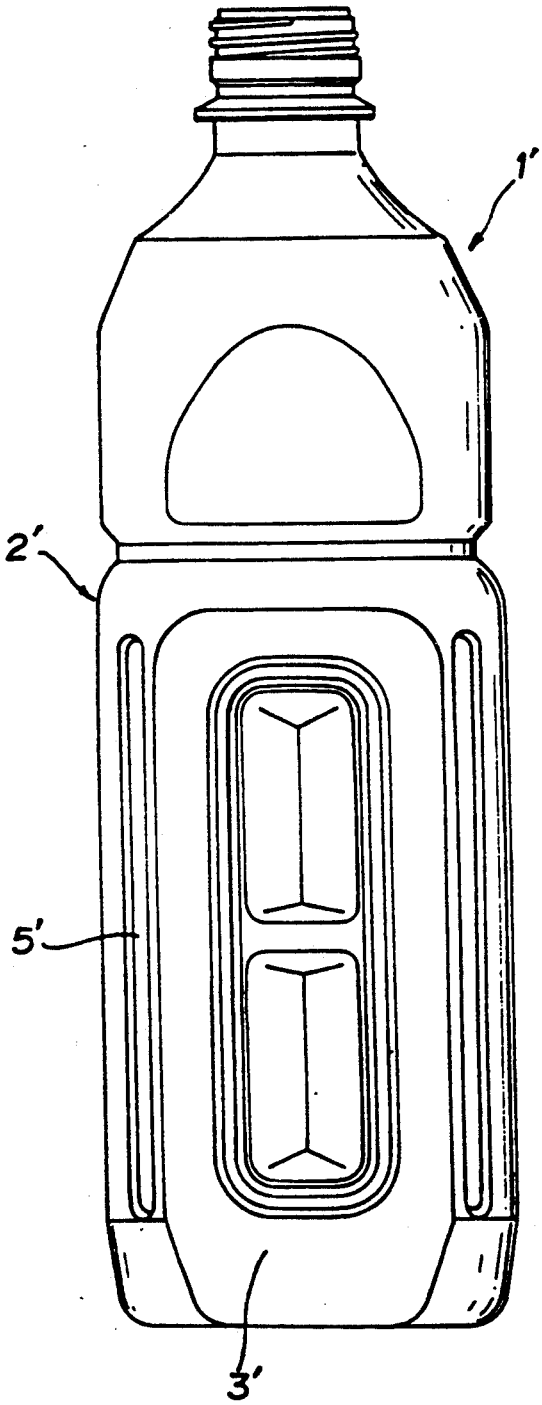
FIG. 3 is a front view of a conventional biaxially blow-molded bottle-shaped container of prior art.

Referring to FIGS. 1 and 2, a ridge line portion at each corner of the generally square cross-sectional body portion 2 may be cut off to provide an elongated flat surface 4 which is vertically extended at each corner. Corner portions 7 are formed at the opposite sides of the flat surface 4. The flat surface 4 is provided with a plurality of depressed cross grooves 5 spaced apart in parallel. A cross ridge 6 is formed between adjacent cross grooves 5, 5 as a portion of the flat surface 4. The cross groove 5 is extended in the circumferential direction of the body portion over the width of the flat surface 4. The cross groove 5 has corners 7*a* formed therein. These corners 7*a* correspond to the corners 7, respectively. Vertical ribs 5*a* are formed between the opposite ends of the cross grooves and the corners 7*a*, respectively. The upper and lower ends of each cross groove 5 act as cross ribs 5*b*.

The corners 7 and 7*a* continuously form a vertical rib which resists to an internal stress in the ridge line portion when the panel wall 3 absorbs the reduced pressure generated within the bottle-shaped container 1. The vertical ribs 5*a* and cross ribs 5*b* together with the cross ridge 6 absorb the external pressing force applied to the bottle-shaped container 1 to elastically deform the flat surface 4.

The bottle-shaped container having the aforementioned construction according to the present invention can carry out the following effects.

Since each ridge line portion stably and rigidly supports the panel wall which is elastically depression deformed owing to the reduced pressure to resist the internal stress caused by the depression-deformation of the panel wall, each panel wall for absorbing the reduced pressure in the bottle-shaped container is elastically depression-deformed. Accordingly, the configuration of the bottle-shaped container can be maintained in the better form when deforming due to the reduced pressure generated within the bottle-shaped container.

When the body portion of the bottle-shaped container which is not filled with a content is subjected to a high external pressing force in the lateral direction, the whole ridge line portions are greatly elastically deformed so that the external pressing force can be absorbed by the elastic deformation of the ridge line portions. Thus, the ridge line portions are not permanently deformed in the form of a buckling- or bending-deformation by the external pressing force to completely prevent occurring of a bottle-shaped container of inferior quality owing to the permanent buckling-deformation of the ridge line portions.

Since the ridge line portions in the corners of the square cylindrical body portion are provided with depressed cross grooves, fingers are snugly fitted in the cross grooves when the body portion is gripped by one hand. Therefore, such a large bottle-shaped container can be safely handled by one hand.

Since the cross grooves are simply depressed in the ridge line portions, the construction is simple and can be easily molded by the conventional manner without necessity of any particular molding technique.

What is claimed is:

1. A biaxially blow-molded bottle-shaped container of synthetic resin, comprising a generally square cross-sectional body portion having four sides and ridge line portions between each pair of adjacent said sides, each said side having a flat wall portion which as a panel wall including means for absorbing a reduced pressure generated in the bottle-shaped container, and at least one of said ridge line portions having depressed cross grooves spaced apart in parallel.

2. A biaxially blow-molded bottle-shaped container of synthetic resin, comprising a generally square cross-sectional body portion having four sides and four vertically elongated flat surfaces, each said flat surface being positioned between a pair of adjacent said sides, at least one of said flat surfaces having depressed cross groves spaced apart in parallel and each said side having a flat wall portion which has a panel wall including means for absorbing reduced pressure generated in the bottle-shaped container.

* * * * *